US006393882B1

(12) United States Patent
Higgins

(10) Patent No.: US 6,393,882 B1
(45) Date of Patent: May 28, 2002

(54) VEHICLE LOCK ASSEMBLY INCLUDING A MOUNTING BRACKET

(75) Inventor: Jan W. Higgins, Palmyra, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/469,862

(22) Filed: Dec. 22, 1999

(51) Int. Cl.[7] ..... E05B 9/08

(52) U.S. Cl. ..... 70/370; 70/466; 70/451; 292/DIG. 53

(58) Field of Search ..... 70/370, 466, 451, 70/416, 417; 292/DIG. 53–DIG. 54

(56) References Cited

U.S. PATENT DOCUMENTS

| | | | | | |
|---|---|---|---|---|---|
| 3,287,944 | A | | 11/1966 | Crumb | 70/495 |
| 4,441,345 | A | | 4/1984 | Guarr | 70/240 |
| 4,671,548 | A | | 6/1987 | Häberle et al. | 292/216 |
| 4,756,638 | A | * | 7/1988 | Neyret | 403/261 |
| 4,995,652 | A | * | 2/1991 | Mugnolo et al. | 292/202 |
| 5,172,946 | A | | 12/1992 | Dowling | 292/216 |
| 5,297,405 | A | | 3/1994 | Manning et al. | 70/208 |
| 5,372,023 | A | * | 12/1994 | Huang | 70/247 |
| 5,551,268 | A | * | 9/1996 | Carnes et al. | 70/370 |
| 5,884,512 | A | * | 3/1999 | Wayne | 70/370 |
| 5,931,035 | A | * | 8/1999 | Bolton | 70/367 |
| 5,987,943 | A | | 11/1999 | Verga et al. | 70/208 |
| 6,079,241 | A | * | 6/2000 | Burleigh et al. | 70/370 |
| 6,161,404 | A | * | 12/2000 | Westwinkel | 70/370 |

* cited by examiner

*Primary Examiner*—B. Dayoan
*Assistant Examiner*—John B. Walsh
(74) *Attorney, Agent, or Firm*—Michael Best & Friedrich LLP

(57) ABSTRACT

A vehicle lock assembly including a cylinder lock and a mounting bracket which is adapted to mount the cylinder lock on a vehicle structure associated with a deck lid of a vehicle. The mounting bracket includes a mounting lug adapted to be fastened to the vehicle structure and mounting arms which support the cylinder lock rearwardly of the exterior panel. The lock mounting arms define mounting surfaces which cooperate with indexing portions on the lock housing to substantially prevent rotation of the cylinder lock relative to the mounting bracket and the deck lid. In one embodiment, the lock housing is mounted on the mounting bracket in dovetail fashion to prevent the mounting arms from spreading apart if an attempt is made to forcibly rotate the cylinder lock.

26 Claims, 7 Drawing Sheets

VEHICLE LOCK ASSEMBLY INCLUDING A MOUNTING BRACKET

BACKGROUND OF THE INVENTION

Field of the Invention

The present invention relates generally to vehicle lock assemblies, and more particularly, to a vehicle lock assembly including a mounting bracket for mounting a cylinder lock on an exterior door, such as a deck lid or passenger door, and the like of a motor vehicle.

Cylinder locks are used on motor vehicles to secure rear deck lids or passenger doors and the like. The cylinder locks are key operated to release a latching mechanism that normally keeps the deck lid or passenger door closed and locked. Typically, the cylinder locks are mounted directly to a relatively thin exterior sheet metal panel which forms the exterior of a deck lid or a passenger door, for example. Although the locks are designed to resist compromising of the lock assembly itself, the application of force to the cylinder lock can cause the relatively thin sheet metal which supports the cylinder lock to bend and deform, displacing the lock relative to the latching mechanism which can result in unlatching of the deck lid or passenger door.

Various methods can be used in an attempt to compromise a vehicle lock system. One commonly used method is to insert a tool, such as a screw driver or other flat bladed instrument, into the key slot of the lock, and then lift or rotate the tool, thereby tilting or rotating the lock relative to the deck lid or passenger door on which the lock is mounted.

Because such vehicle locks generally are supported only by the relatively thin exterior sheet metal panel of the deck lid or passenger door, the application of a lifting force to the outer end of the cylinder lock can result in deforming of the exterior sheet metal, tilting the cylinder lock such that the inner end of the cylinder lock is moved downwardly. Many vehicle cylinder locks include a latch rod for coupling the lock cylinder to a latch release mechanism. When the inner end of the cylinder lock is moved downwardly, the latch rod is moved downwardly, operating the latch release mechanism, releasing a latching member from a lock bar or striker. Similarly, forcibly rotating the cylinder lock clockwise, for example, can cause the latch bar to be moved downwardly, releasing the latching mechanism.

A degree of anti-rotation protection for cylinder locks can be provided through the use of ribs projecting from the outer surface of the lock housing. The ribs are received in mating slots in the exterior sheet metal panel for anti-rotation purposes. However, when sufficient rotational force is applied to the lock cylinder, the projections will be forced out of the slots, or the sheet metal will be stripped. In either case, the forced rotation of the lock housing and lock cylinder will result in releasing of the latching mechanism.

A further consideration is the affect of vibration on motor vehicle cylinder locks. Testing has shown that when cylinder locks are mounted on an exterior sheet metal panel of a vehicle using standard mounting techniques, there will be excessive movement of the cylinder lock when the sheet metal panel on which the cylinder lock is mounted is subjected to vibration.

Thus, it would be desirable to have a cylinder lock assembly for deck lids and other exterior door locks of a motor vehicle that is more resistant to tampering and more immune to the effects of vibration, and which does not require a large number of additional parts, and which does not increase the number of steps in the assembly process to incorporate a cylinder lock stabilizing mechanism.

SUMMARY OF THE INVENTION

The disadvantages and limitations of the background art discussed above are overcome by the present invention. With this invention, there is provided a lock assembly for a motor vehicle having a sheet metal panel which normally closes an exterior opening of the vehicle. The lock assembly comprises a cylinder lock and a mounting bracket. The mounting bracket is adapted to mount the cylinder lock on a vehicle structure with the cylinder lock supported by the mounting bracket near a first end thereof and with a second end secured to the exterior sheet metal panel, located within an opening in the panel. The mounting bracket includes at least one mounting lug adapted to be fastened to the vehicle structure and a lock mounting portion adapted to support the cylinder lock near its second end, rearwardly of the exterior panel. The lock mounting portion defines mounting surfaces which cooperate with first and second indexing portions on the lock housing to support the cylinder lock and substantially prevent rotation of the cylinder lock relative to the mounting bracket and the sheet metal panel.

In one embodiment, the lock mounting portion includes first and second arms which project from a base portion of the mounting bracket and which define the mounting surfaces. In accordance with the invention, the lock housing is mounted on the mounting bracket in dovetail fashion to prevent the first and second arms from spreading apart if an attempt is made to forcibly rotate the cylinder lock. In addition, the mounting bracket itself is adapted to cooperate with the vehicle structure to resist forcible rotation of the lock.

It has been found that it is advantageous to provide some clearance between mating surfaces of the cylinder lock and the mounting bracket because that makes the cylinder lock assembly and the exterior sheet metal panel on which the cylinder lock is mounted less prone to destruction. Thus, a small gap is provided between mating surfaces of the cylinder lock and the mounting bracket to allow some give to resist deformation of the exterior sheet metal if an attempt is made to compromise the vehicle lock system.

Another important advantage of the invention is that installation of the mounting bracket does not require an additional step in the assembly process. The mounting bracket can be slid onto the cylinder lock along with a switch of the cylinder lock, as the switch is being installed on the cylinder lock. The mounting bracket is held in place by the switch while the switch is being secured to the cylinder lock. No additional process step is required because the mounting bracket is installed with the switch as a unit.

DESCRIPTION OF THE DRAWINGS

These and other advantages of the present invention are best understood with reference to the drawings, in which.

DETAILED DESCRIPTION OF THE PREFERRED EMBODIMENT

Figure 1:
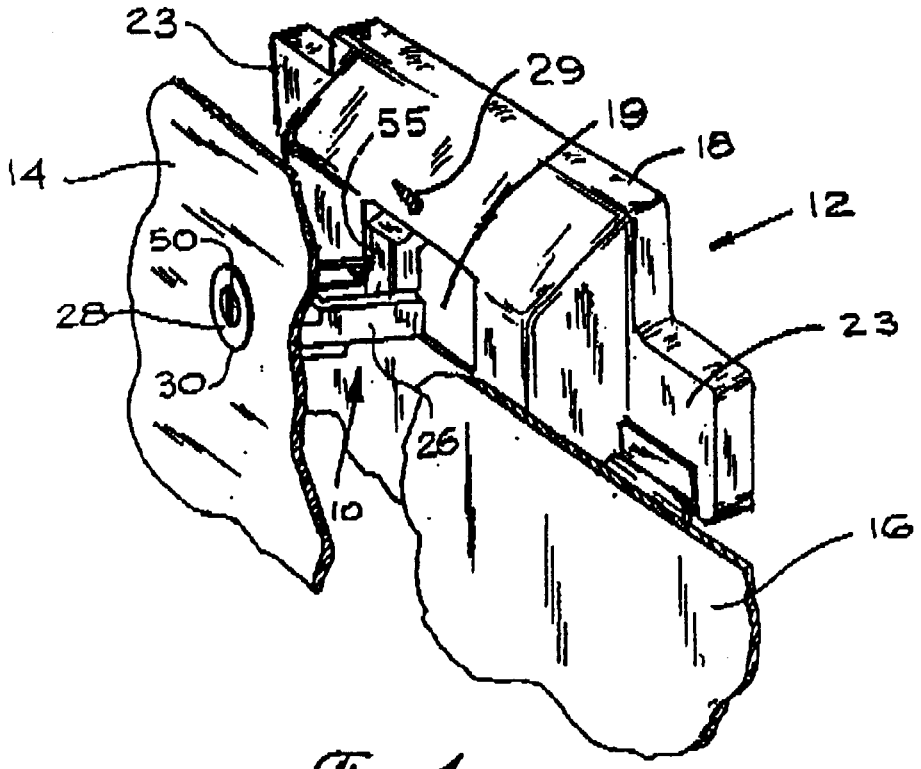
FIG. 1 is a fragmentary isometric view of a deck lid of a motor vehicle, partially cut away to show a cylinder lock assembly provided by the invention, the cylinder lock assembly being shown mounted to vehicle structure associated with the deck lid.
Figure 2:
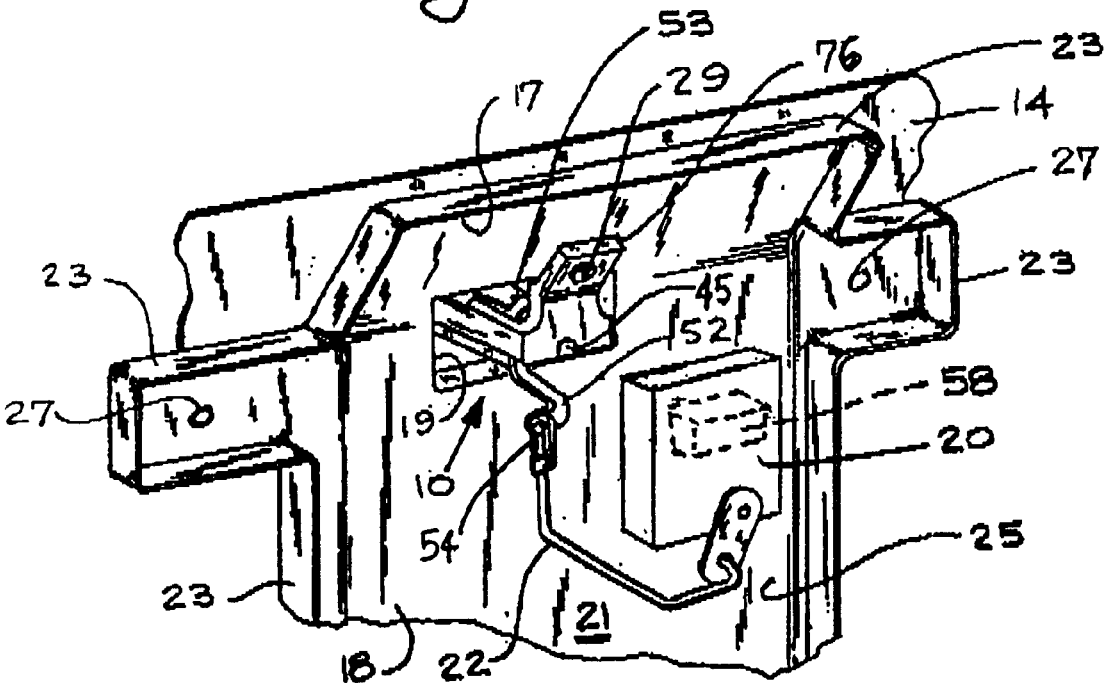
FIG. 2 is an enlarged fragmentary rear isometric view showing a control mechanism mounted on a control plate, the control mechanism being coupled to a cylinder lock of the cylinder assembly provided by the invention, and showing the cylinder lock mounted to the control plate by a mounting bracket of the cylinder lock assembly.
Figure 3:
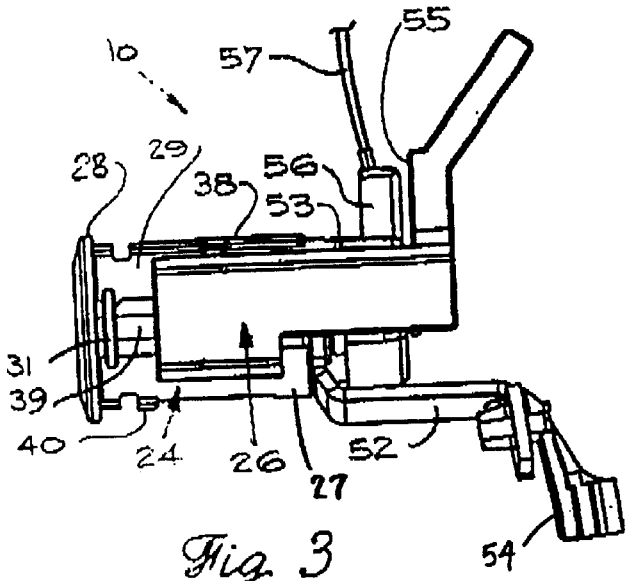
FIG. 3 is a side elevation view of the cylinder lock assembly provided by the present invention.
Figure 4:
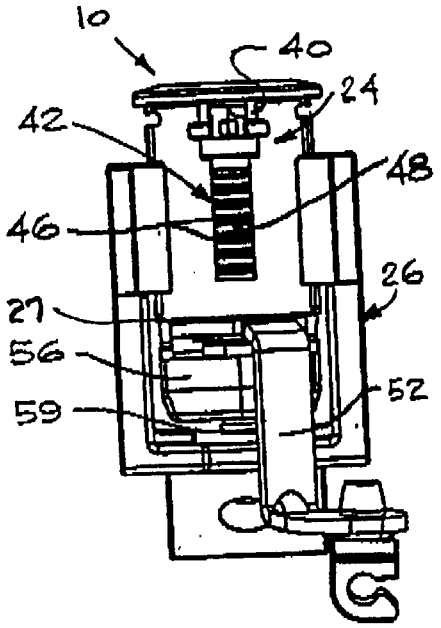
FIG. 4 is a bottom plan view of the cylinder lock assembly of FIG. 3.

Referring to FIGS. 1–4 of the drawings, one preferred embodiment of the cylinder lock assembly provided by the invention is indicated generally at 10. The cylinder lock assembly 10 includes a cylinder lock 24 and a mounting bracket 26, as shown in FIGS. 3 and 4, for example. The cylinder lock assembly is disclosed with reference to an application for securing a deck lid which closes a rear storage compartment of a motor vehicle. In one embodiment, the cylinder lock assembly 10 is mounted to vehicle structure, indicated generally at 12, associated with the deck lid. However, the cylinder lock assembly can be mounted to vehicle structure associated either with a deck lid or with the vehicle body depending on the particular application. The cylinder lock assembly provided by the invention can be used with any exterior door of a motor vehicle. Moreover, although the cylinder lock assembly 10 provided by the invention is particularly suitable for use with deck lids or passenger doors, and the like, the cylinder lock assembly can be used for other vehicle locks, such as hood locks.

In FIGS. 1 and 2, the vehicle structure 12 associated with the deck lid includes an outer sheet metal panel 14 which forms the exterior of the deck lid, and an inner sheet metal panel 16 which provides reinforcement and strengthening for the deck lid. In addition, a control plate 18, which is mounted on the inner sheet metal panel 16, provides structural support for some of the components of a conventional latching mechanism (not shown) that keeps the deck lid closed and locked. At least a portion of the latching mechanism can be contained within a housing 20 and can include components for operating a latch member (not shown) which cooperates with a lock bar or striker (not shown) for controlling the latching and the unlatching of the deck lid. Further components of the latching mechanism, such as the latch member, can be mounted to the control plate 18 below the housing 20. The lock bar or striker can be mounted on the vehicle rear compartment structure (or the deck lid) depending upon where the latching mechanism and the cylinder lock assembly are mounted. The latching mechanism can also include a solenoid actuated remote release mechanism, allowing remote release of the deck lid from inside the passenger compartment of the motor vehicle. A control rod 22 mechanically links the cylinder lock 24 to the solenoid operated components contained within the housing 20.

The control plate is generally rectangular in shape and includes a flat base 21 with side walls 23, defining a recessed portion 25 in which the latching mechanism and solenoid housing 20 are mounted. In one embodiment, the upper end of the control plate is bent at an angle with respect to the base 21, defining an inclined surface 17. The control plate has wings 27 at opposite sides of the base 21. The wings 27 are adapted for securing the control plate 18 to the inner sheet metal panel 16.

Referring also to FIGS. 3–6, the mounting bracket 26 is dimensioned and configured to receive and support the cylinder lock 24 near the rearward or inner end 27 of the lock 24, with the forward or outer end 28 of the cylinder lock projecting from the mounting bracket 26.

As shown in FIGS. 1 and 2, the cylinder lock 24 and the mounting bracket 26 extend through a cut out 19 in the control plate 18. The mounting bracket 26 is removably fastened to the inclined surface 17 of the control plate 18 of the deck lid by a suitable fastener, such as a machine screw 29. The forward end 28 of the cylinder lock 24 extends through an opening 30 in the outer sheet metal panel 14 and is secured to the outer sheet metal panel 14 by an fastener, such as an e-ring (not shown), at the back surface of the sheet metal panel 14, in the known manner. The e-ring is received in a peripheral groove 31 in the outer surface of the lock housing 36. The lock housing 36 has axial ribs 37, 38, 39 and 40 (FIGS. 4–6) that mate with slots (not shown) spaced around the periphery of the opening 30 for orienting the key slot of the cylinder lock with respect to the deck lid, in the known manner, during installation of the cylinder lock on the deck lid. Preferably, the ribs 37, 38, 39 and 40 are of different sizes and/or shapes. In one embodiment, at least one of the ribs 39 is larger than the other ribs for indexing purposes in the manner known in the art.

Although the mounting bracket 26 provided by the invention is described with reference to a preferred embodiment for mounting a cylinder lock 24 on a deck lid of a motor vehicle, the mounting bracket 26 can be used to mount the cylinder lock 24 on a door, hood, or other panel of a motor vehicle, it being understood that the shape of the mounting bracket 26 can be different as a function of the particular application. Moreover, the mounting bracket 26 is particularly suited for mounting any sheet metal mounted lock and can be used for other lock mounting applications.

Figure 5:
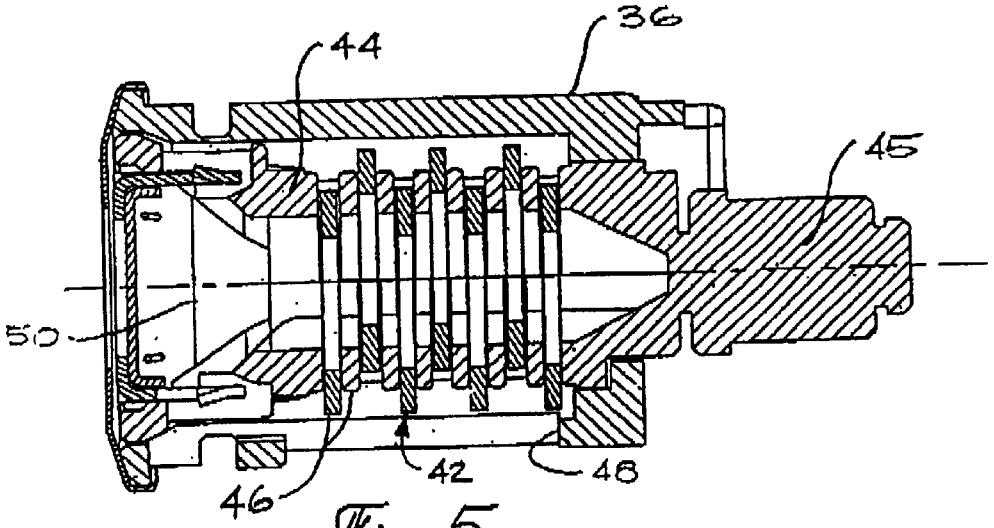
FIG. 5 is a vertical section view of a subassembly of the cylinder lock assembly.

Referring to FIGS. 3–5, the cylinder lock 24 includes a locking mechanism 42 contained within a lock housing 36. The locking mechanism 42 of the cylinder lock 24 is conventional and accordingly will not be described in detail. Briefly, the locking mechanism 42 includes a lock cylinder 44 rotatable between locked and unlocked positions. The lock cylinder 44 carries a plurality of tumblers 46 which cooperate with a tumbler ward 48 in the lock housing 36 in the known manner. The lock cylinder 44 has a key slot 50

(FIG. 1) for receiving a key for withdrawing the tumblers 46 to allow the lock cylinder 44 to be rotated to the unlocked position. The rearward end of the lock cylinder 44 includes a shaft 45 (FIG. 2) which is coupled to a lock bar 52 in the known manner. The lock bar 52 has a clip 54 to facilitate connection of the lock bar 52 to the control rod 22 as shown in FIG. 2.

The cylinder lock 24 can include a switch 56 for providing a control function in response to rotation of the lock cylinder 44 with the proper key. In one embodiment, the switch 56 is connected through a cable 57 to a solenoid 58 of the remote release mechanism. When a proper key is inserted into the lock and turned in the lock, the switch 56 is operated, actuating the solenoid 58. The solenoid 58 can also be actuated using a portable RF signal transmitter, or fob, in the known manner.

The switch 56 is mounted at the rearward end 27 of the cylinder lock, spaced apart from the mounting bracket 26, as shown in FIGS. 3 and 4. The switch 56 is located in a space defined by the rearward end 53 of the lock housing 36 and the forward surface 55 of a base portion 74 of the mounting bracket 26. The switch 56 is held in place on the shaft 45 of the lock by the e-ring 59, in the manner known in the art.

As stated above, the locking mechanism 42 of the cylinder lock 24 can be conventional. However, the lock housing 36 differs from conventional lock housings in that the lock housing 36 is configured to cooperate with the mounting bracket 26 to provide theft deterrents in accordance with the present invention as will be shown.

Figure 6:
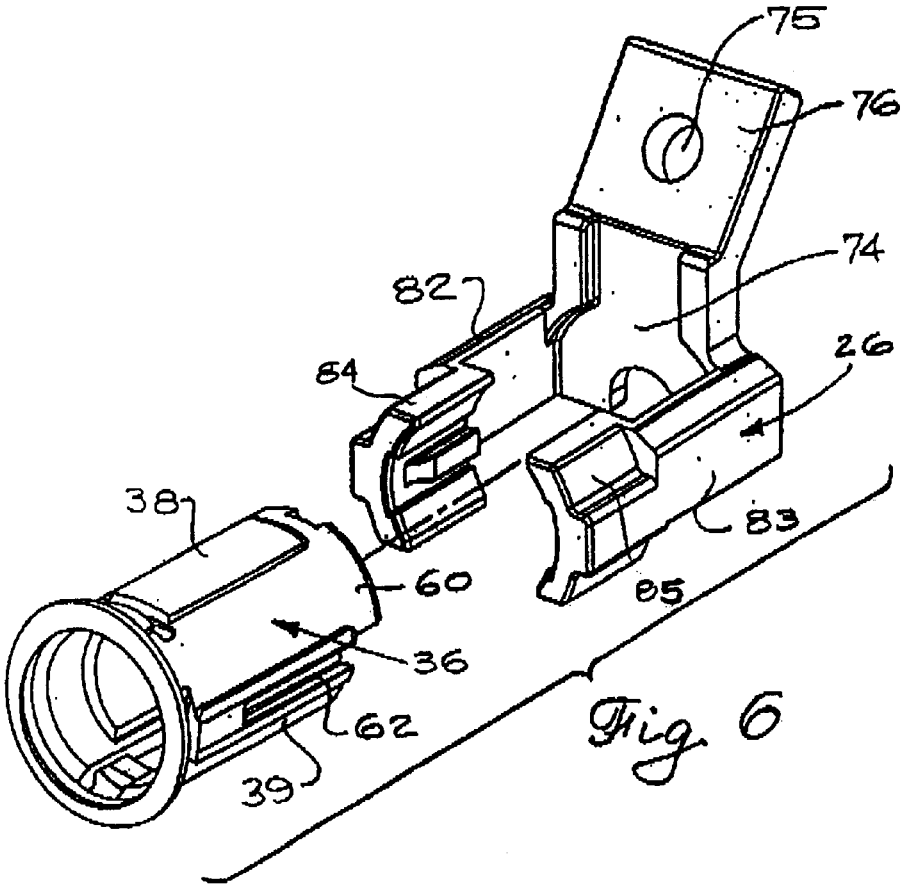
FIG. 6 is an exploded isometric view of a lock housing of the cylinder lock and the mounting bracket provided by the invention.
Figure 7:
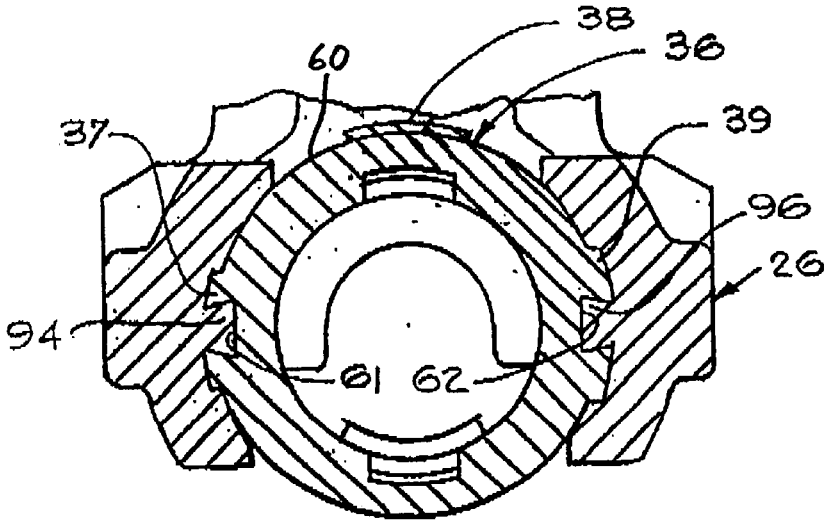
FIG. 7 is a vertical section view of the lock housing shown assembled with the mounting bracket, and illustrating the dovetail connection between the lock housing and the mounting bracket.

Considering the lock housing 36 and the mounting bracket 26 in more detail, FIG. 6 is an exploded view of the lock housing 36 and the mounting bracket 26. FIG. 7 is a view showing the lock housing 36 assembled with the mounting bracket 26. The lock housing 36 is generally cylindrical in shape and in one embodiment, the ribs 37, 38, 39 and 40 are equally spaced about the circumference of the outer surface 60 of the lock housing. The two indexing ribs 37 and 39 which are located at diametrically opposed positions on the sides of the lock housing 36, mate with mounting surfaces on the mounting bracket 26 as will be described. In one embodiment, the lock housing 36 is made of a metal, such as a zinc alloy.

Figure 8:
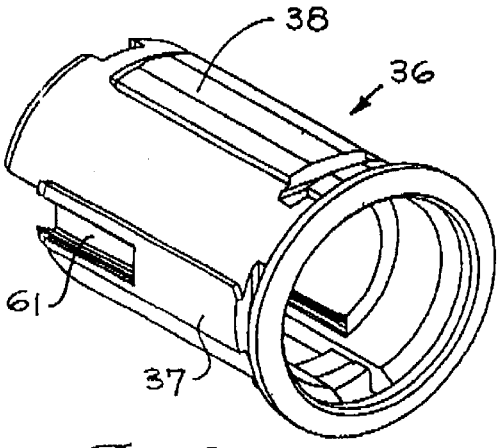
FIG. 8 is a front isometric view of the lock housing of FIG. 6.
Figure 9:
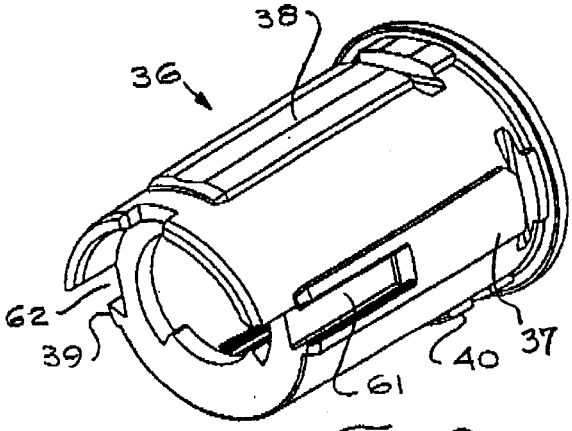
FIG. 9 is a rear isometric view of the lock housing of FIG. 6.
Figure 10:
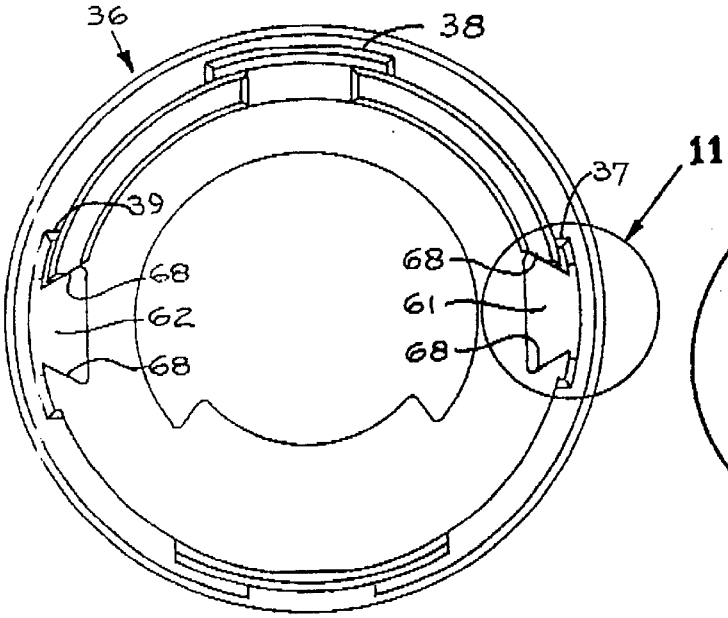
FIG. 10 is an enlarged rear view of the lock housing of FIG. 8.
Figure 11:
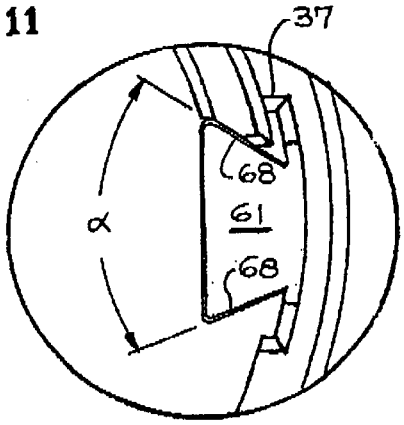
FIG. 11 is detail view of a portion of the lock housing contained within the circle in FIG. 10.
Figure 12:
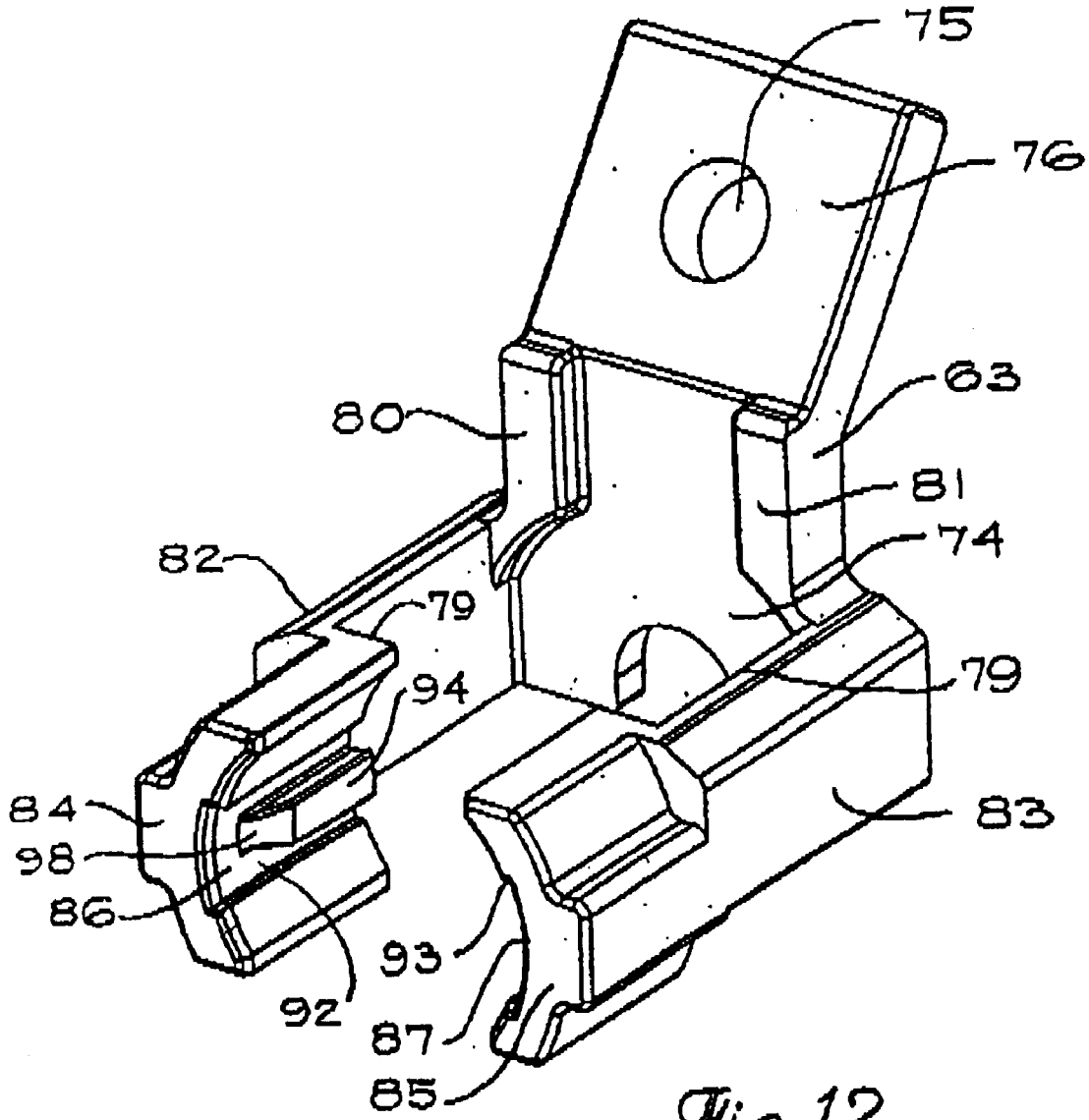
FIG. 12 is an isometric view of a mounting bracket provided by the invention.
Figure 13:
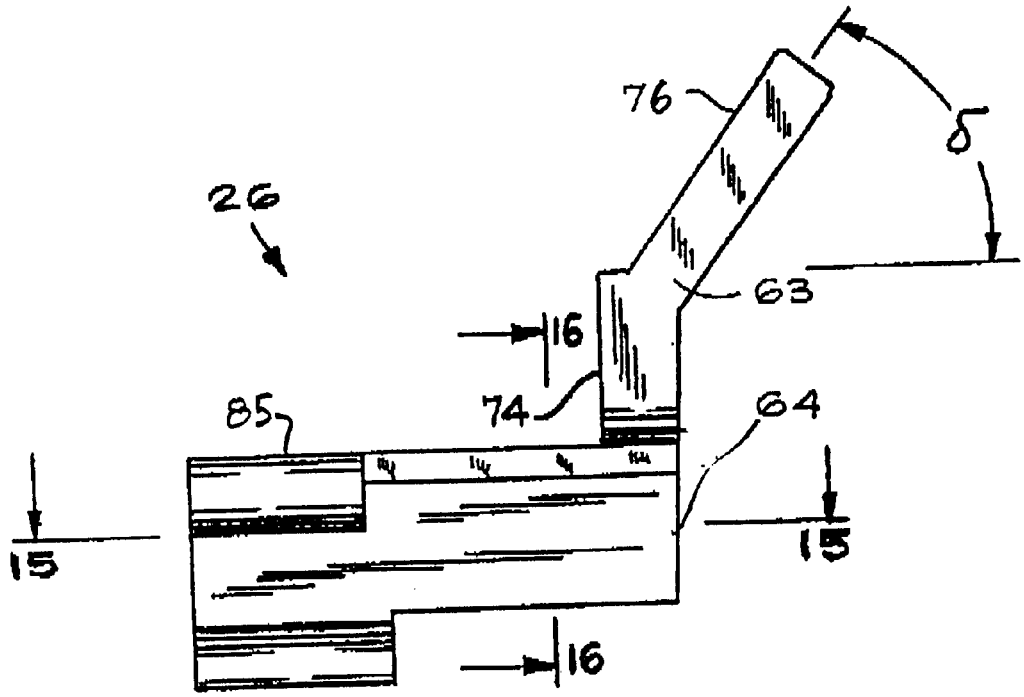
FIG. 13 is a side elevation view of the mounting bracket of FIG. 12.
Figure 14:
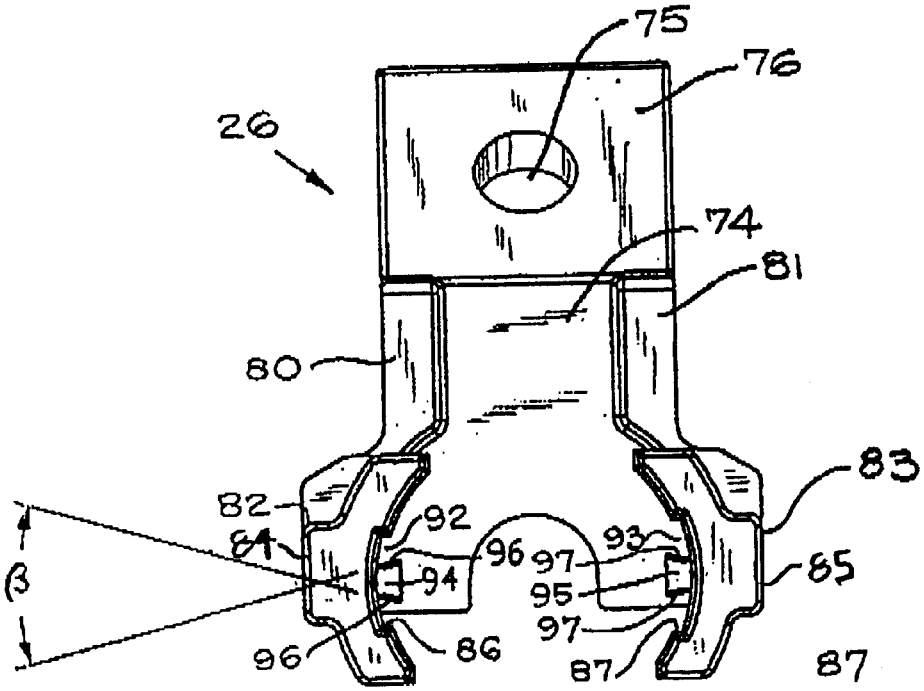
FIG. 14 is a front elevation view of the mounting bracket of FIG. 12.

More specifically, referring also to FIGS. 8–10, in one embodiment, the rearward or leading end portion of indexing rib 37 includes a groove or slot 61 which extends about one-half of the axial length of the rib 37. Similarly, the rearward or leading end of indexing rib 39 includes a groove or slot 62 which extends about one-half of the axial length of the rib 39. The inner surfaces 68 of the grooves 61 and 62 taper inwardly from the outer end of the grooves 61 and 62 to the base of the grooves, defining a generally trapezoidal, cross section for each of the grooves 61 and 62 as shown in detail in FIG. 11, for example. In one embodiment, the angle $\alpha$ (FIG. 11) between the surfaces of the grooves 61 and 62 is in the range of about 50° to about 70°, and the angle $\alpha$ preferably is about 60°. In one embodiment, the circumferential width of the rib 37 is less than the circumferential width of the rib 39. The cross sectional area of the groove 62 is the same as the cross sectional area of the groove 61.

However, the relative sizes of the ribs 37 and 39 and of the grooves 61 and 62 can be different depending upon application. Moreover, the sizes of the ribs 37 and 39 and of the grooves 61 and 62 are dictated to some extent by the size and shape of the mounting bracket 26 the configuration and dimensions of which can vary as a function of application.

Referring to FIGS. 6, 7 and 12–14, the mounting bracket 26 includes a base portion 74, a mounting lug 76 and a pair of arms 82 and 83. The mounting lug 76 is adapted to be fastened to the control plate 18. In one embodiment, the mounting lug 76 projects outwardly at an angle from one end 63 of the base portion 74. The angle $\delta$ between the generally vertical base portion 74 and the mounting lug 76 is selected as a function of the application and in one preferred embodiment the angle $\delta$ is about 54°. This enables the mounting lug 76 to lie substantially flat on the sloping surface 17 of the control plate 18 (FIG. 2) to which the mounting lug is fastened. The mounting lug can include an opening 75 for receiving machine screw 29 (FIG. 2) for removably fastening the mounting bracket 26 to the control plate 18. In one embodiment, the mounting bracket 26 is made of metal, such as a zinc alloy.

Figure 16:
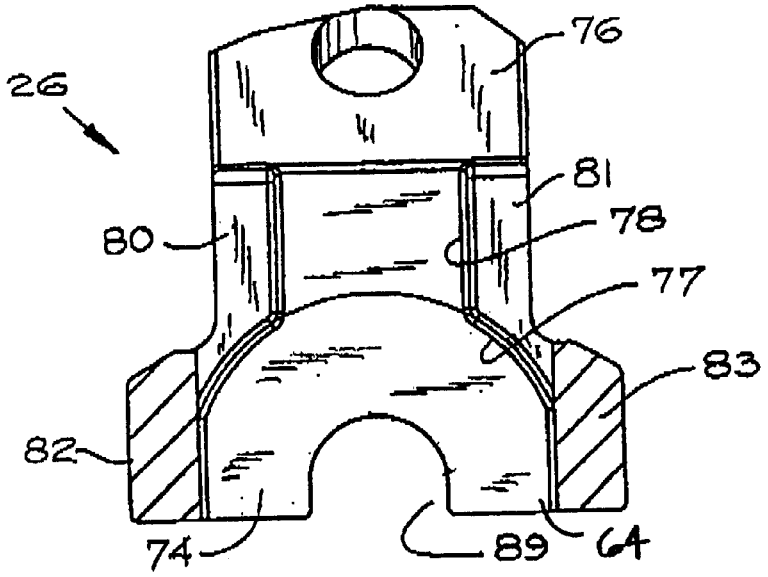
FIG. 16 is a vertical section view taken along the line 16—16 of FIG. 13.

Referring also to FIG. 16, the base portion 74 includes a pair of shoulders or ribs 80 and 81 which are spaced apart from one another to extend generally vertically along opposite sides of the base portion 74. The ribs 80 and 81 engage the upper edge of the opening or cutout 19 in the control plate 18, cooperating with the control plate 18 to prevent rotation of the mounting bracket 26 relative to the control plate 18 when an attempt is made to forcibly rotate the cylinder lock 24. The base portion 74 is contoured complementary to the shape of the rearward portion of the switch 56 to provide some clearance between the switch 56 and the mounting bracket 26. The base portion includes a recessed portion 77, generally arcuate in shape, which extends between the two arms 82 and 83, and a vertical recessed portion 78, generally rectangular in shape, defined by the shoulders 80 and 81. The switch 56 does not reach back to the base portion. The base portion 74 includes an arcuate opening 89 at its lower edge which provides clearance for the end of the shaft 45 (FIG. 2).

Figure 15:
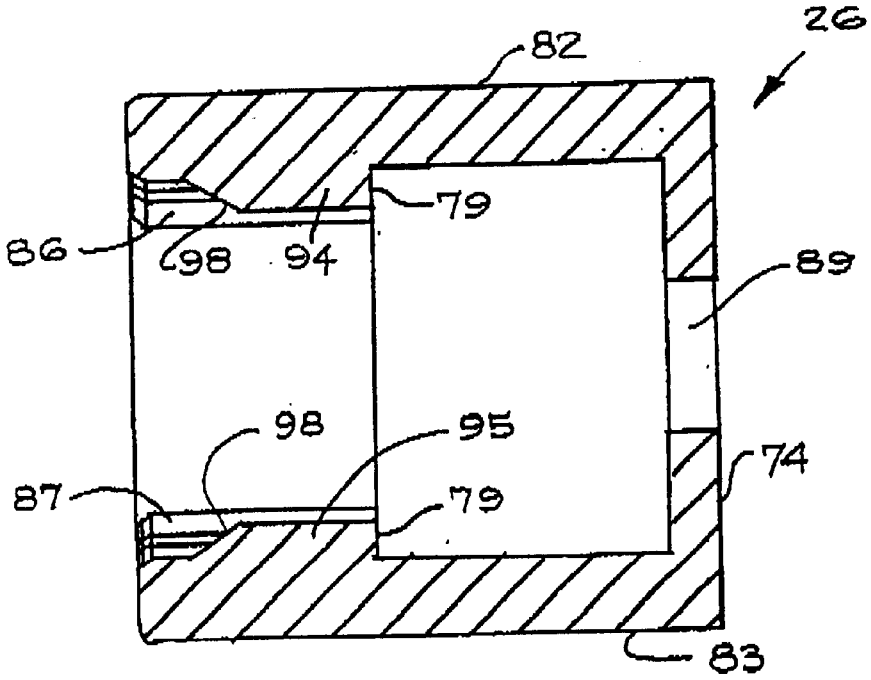
FIG. 15 is a transverse section view taken along the line 15—15 of FIG. 13.

The arms 82 and 83 extend generally perpendicular to the base portion 74 near the end 64 of the base portion 74. The arms 82 and 83 have respective end portions 84 and 85 which are generally arcuate in shape for receiving the cylindrical lock housing 36 of the cylinder lock 24. The arcuate end portions 84 and 85 are spaced apart from one another defining an opening for receiving the cylinder lock Referring also to FIG. 15, the inner surface of the arm 82 of the mounting bracket 26 defines mounting surface 86. Similarly, the inner surface of the arm 83 of the mounting bracket 26 defines mounting surface 87. The arms 82 and 83 are stepped inwardly, as indicated at 79, at the locations of the mounting surfaces 86 and 87. The mounting surfaces 86 and 87 cooperate with the indexing portions 37 and 39 of the lock housing 36 of the cylinder lock 24 to prevent rotation of the cylinder lock 24. In addition, the mounting surfaces 86 and 87 limit rearward axial movement of the cylinder lock 24 relative to the mounting bracket 26 providing a positive stop for the cylinder lock as the cylinder lock is being slid into place on the mounting bracket.

The mounting surface 86 includes a channel 92, having a raised portion 94 with inwardly tapering sides 96. The sides 96 of the raised portion 94 taper inwardly at an angle $\beta$ which is approximately the same as the taper angle $\alpha$ of the sides of the indexing grooves 62 and 63. In one embodiment, the angle $\beta$ is in the range of about 50° to about 70°, and the angle $\beta$ preferably is about 60°.

Similarly, the mounting surface 87 of arm 83 includes a channel 93, having a raised portion 95 with inwardly tapering sides 97. The sides 97 of the raised portion 95 taper inwardly at angle $\beta$. In one embodiment, the raised portion 94 of arm 82 has the same cross sectional size as the raised portion 95 of arm 83. However, the raised portion 94 of arm 82 can be larger than, or smaller than, the raised portion 95 of arm 83, with the shape and sizes of portions 94 and 95 being conformed to the shape and sizes of the mating portions, i.e., ribs 37 and 39 and grooves 61 and 62, of the lock housing. In addition, the channel 92 of arm 82 is wider than the channel 93 of arm 83. The forward ends 98 of the raised portions 94 and 95 are beveled, defining ramped guiding surfaces for receiving and guiding the indexing grooves 61 and 62 of the lock housing 36 during assembly of the cylinder lock 24 with the mounting bracket.

In accordance with the invention, the cylinder lock is dovetailed onto the mounting bracket 26. That is, the groove 61 in the rib 37 of the lock housing 36 and the raised portion 94 of the arm 82 have complementary profiles and form a first dovetail joint. The groove 62 in the rib 39 of the lock housing 36 and the raised portion 95 of the arm 83 have complementary profiles and form a second dovetail joint.

The groove 61 in rib 37, with its tapering outer sides 68, defines a mortise of a dovetail joint and the raised portion 94 of channel 92 of arm 82 defines a tenon of that dovetail joint. The groove 62 in rib 39, with its tapering outer sides 68, defines a mortise of a further dovetail joint, and the raised portion 95 of channel 93 of arm 83 defines a tenon of the further dovetail joint. The dovetail joints prevent the arms 82 and 83 from being forced apart in the event that the cylinder lock is forcibly rotated without a proper key in the lock. If an attempt is made to forcibly rotate the lock cylinder and/or the lock housing, the engagement of dovetailed surface portions 68 of lock housing 36 and surface portions 96 of arm 82, and the engagement of dovetailed surface portions 68 of lock housing 36 and surface portions 96 of the arm 83, provide a "hooking action" that prevents the arms 82 and 83 from being forced outwardly away from each other as cylinder lock is forcibly rotated clockwise or counterclockwise.

The side surfaces of the channels and the mating surfaces of the ribs 37 and 39 are substantially straight in an axial direction to produce more positive mounting of the cylinder lock 24 in the mounting bracket 26. This slip fit provides a degree of give between the cylinder lock 24 and the mounting bracket 26. The slip fit also allows replacement of the cylinder lock 24 by simply sliding the cylinder lock 24 out of the mounting bracket 26, without removing the mounting bracket 26 from the deck.

The tolerances between mating surfaces of the mounting bracket 26 and the lock housing 36 are selected such that some space or clearance is provided between the mating surfaces, particularly in the regions of the dovetail joints. This makes the dovetail joints less prone to allow damage to or destruction of the exterior sheet metal panel 14 of the deck lid on which the cylinder lock assembly 10 is mounted. There is a small gap between the mating parts of the lock housing 36 and the mounting bracket 26 to provide a degree of give. This is an important factor in reducing or minimizing susceptibility of the sheet metal of the deck lid to deformation as the result of attempts at compromising the cylinder lock 24 such as by forcefully turning the lock cylinder 44 using a screw driver or other tool.

Assembling the mounting bracket 26 with the cylinder lock requires no additional steps in the assembly process and no additional tools. The mounting bracket 26 can be slid on as the switch 56 is being installed. The switch 56 and bracket 26 are put on as a unit, nested together, and then the e-ring 59 is put on to hold the switch 56 in place on the cylinder lock 24. The shoulders of the switch 56, which are located rearwardly of the inwardly stepped ends 84 and 85 of the mounting bracket arms 82 and 83, maintain the mounting bracket 26 on the cylinder lock until the mounting bracket 26 subsequently is fastened to the control plate 18.

In one preferred assembly process, the mounting bracket 26 is applied at a time while the deck lid is positioned in an upright position during the assembly process. The mounting bracket 26 is held in place on the cylinder lock by the e-ring 59 that secures the switch 56 to the cylinder lock 24, and the mounting bracket 26 can hang down. The mounting bracket 26 can be secured to the control plate 18 later in the assembly process. The mounting bracket 26 can be shipped as part of an assembly with the cylinder lock 24.

The support for the cylinder lock 24 provided by the mounting bracket 26 substantially eliminates relative movement between the cylinder lock 24 and the outer sheet metal panel 14 and/or the control plate 18. The mounting bracket 26 also resists "tipping" of the lock and/or deforming of the sheet metal. The dovetail arrangement between the mounting arms and the cylinder lock prevents the mounting arms from being forced apart if the cylinder lock 24 is forcibly rotated. Moreover, the cooperation between the shoulders 80 and 81 of mounting bracket 26 and the control plate 18 provide resistance to rotation of the cylinder lock assembly 10 relative to the latching mechanism of the lock system.

Mounting a conventional cylinder lock on a deck lid or other exterior door of a motor vehicle in the standard manner with the cylinder lock supported only by the exterior sheet metal panel of the deck lid generally will result in excessive movement of the cylinder lock when subjected to vibration. The mounting bracket 26 provided by the present invention, stabilizes the cylinder lock installation, thereby minimizing movement of the cylinder lock assembly as may be caused by vibration.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A lock assembly for a motor vehicle, the motor vehicle having a panel for closing an opening of the vehicle, said lock assembly comprising:

a cylinder lock including a lock housing having an outer surface, at least first and second indexing portions on said outer surface of said lock housing; and a mounting bracket for mounting said cylinder lock on a vehicle structure associated with the panel with an end of said cylinder lock mounted within an opening in the panel, said mounting bracket including at least one mounting lug adapted to be fastened to the vehicle structure, first and second raised portions cooperating with a portion of the vehicle structure to substantially prevent rotation of the mounting bracket relative to the vehicle structure, and a lock mounting portion adapted to support said cylinder lock rearwardly of the panel, said lock mounting portion defining mounting surfaces which cooperate with said first and second indexing portions on said lock housing to support said cylinder lock and to substantially prevent rotation of said cylinder lock relative to said mounting bracket and said panel.

2. A lock assembly for a motor vehicle, the motor vehicle having a panel for closing an opening of the vehicle, said lock assembly comprising:

a cylinder lock including a lock housing having an outer surface, at least first and second indexing portions on said outer surface of said lock housing; and a mounting bracket for mounting said cylinder lock on a vehicle structure associated with the panel with an end of said cylinder lock mounted within an opening in the panel, said mounting bracket including at least one mounting lug adapted to be fastened to the vehicle structure, and a lock mounting portion adapted to support said cylinder lock rearwardly of the panel, said lock mounting portion defining mounting surfaces which cooperate with said first and second indexing portions on said lock housing to support said cylinder lock and to substantially prevent rotation of said cylinder lock relative to said mounting bracket and said panel, wherein a first one of said mounting surfaces cooperates with said first indexing portion to define a first dovetail joint between the lock housing and the mounting bracket, and a second one of said mounting surfaces cooperates with said second indexing portion to define a second dovetail joint between the lock housing and the mounting bracket.

3. The lock assembly according to claim 1, wherein said mounting bracket includes a base portion, said lock mounting portion including first and second arms extending outwardly from said base portion, said first and second arms having first and second inner surfaces which define first and second ones of said mounting surfaces.

4. The lock assembly according to claim 3, wherein said first and second arms extend from said base portion near a first end of said base portion, and said mounting lug projects from said base portion near a second end of said base portion.

5. A lock assembly for a motor vehicle, the motor vehicle having a panel for closing an opening of the vehicle, said lock assembly comprising:

a cylinder lock including a lock housing having an outer surface, at least first and second indexing portions on said outer surface of said lock housing; and a mounting bracket for mounting said cylinder lock on a vehicle structure associated with the panel with an end of said cylinder lock mounted within an opening in the panel, said mounting bracket including at least one mounting lug adapted to be fastened to the vehicle structure, and a lock mounting portion adapted to support said cylinder lock rearwardly of the panel, said lock mounting portion defining mounting surfaces which cooperate with said first and second indexing portions on said lock housing to support said cylinder lock and to substantially prevent rotation of said cylinder lock relative to said mounting bracket and said panel, wherein said mounting bracket includes a base portion, said lock mounting portion including first and second arms extending outwardly from said base portion, said first and second arms having first and second inner surfaces which define first and second ones of said mounting surfaces, and wherein at least said first inner surface of said first arm includes a channel having a raised portion with inwardly tapering sides, and wherein at least said first indexing portion of said lock housing includes a slot having a profile that is complementary to the profile of said raised portion of said first inner surface.

6. The lock assembly according to claim 3, wherein said first and second arms have end portions with surfaces which are generally arcuate in shape, said arcuate end portions being spaced apart from one another defining an opening for receiving said lock housing of said cylinder lock.

7. The lock assembly according to claim 5, wherein said second inner surface of said second arm includes a channel having a raised portion with inwardly tapering sides, and wherein one of said raised portions is larger than the other one of said raised portions.

8. A lock assembly for a motor vehicle, the motor vehicle having a panel for closing an opening of the vehicle, said lock assembly comprising:

a cylinder lock including a lock housing having an outer surface, at least first and second indexing portions on said outer surface of said lock housing; and a mounting bracket for mounting said cylinder lock on a vehicle structure associated with the panel with an end of said cylinder lock mounted within an opening in the panel, said mounting bracket including at least one mounting lug adapted to be fastened to the vehicle structure, and a lock mounting portion adapted to support said cylinder lock rearwardly of the panel, said lock mounting portion defining mounting surfaces which cooperate with said first and second indexing portions on said lock housing to support said cylinder lock and to substantially prevent rotation of said cylinder lock relative to said mounting bracket and said panel, wherein said mounting bracket includes a base portion, said lock mounting portion including first and second arms extending outwardly from said base portion, said first and second arms having first and second inner surfaces which define first and second ones of said mounting surfaces, and wherein the base portion includes first and second shoulders for cooperating with a portion of the vehicle structure to substantially prevent rotation of the mounting bracket relative to the vehicle structure.

9. A lock assembly comprising:

a mounting bracket adapted to be fastened to a vehicle structure associated with a deck lid, a door, a hood or other panel of a motor vehicle, said mounting bracket including a base portion, a mounting lug projecting from said base portion, and a lock mounting portion extending from said base portion; and a cylinder lock mounted on said mounting bracket, said cylinder lock including a lock housing having an outer surface including a plurality of ribs projecting outwardly from said outer surface, at least one of said ribs including an axial slot therein;

said lock mounting portion defining at least first and second mounting surfaces including channels for cooperating with said ribs of said lock housing of said cylinder lock to prevent rotation of said lock housing of said cylinder lock relative to at least said mounting bracket, at least one of said ribs including a slot and at least one of said channels including a raised portion that is received in said slot.

10. The lock assembly according to claim 9, wherein said mounting lug is located near a first end of said mounting bracket and said lock mounting portion is located near a second end of said mounting bracket.

11. The combination comprising:

a mounting bracket adapted to be fastened to a vehicle structure associated with an exterior panel of a motor vehicle, said mounting bracket including at least one mounting lug, first and second raised portions and a lock mounting portion; and a cylinder lock received on said mounting bracket, said cylinder lock including a lock housing having an outer surface with a plurality of index portions projecting outwardly from said outer surface;

said lock mounting portion of said mounting bracket defining at least first and second mounting surfaces which cooperate with said index portions of said lock housing to substantially prevent axial movement and rotation of said cylinder lock with respect to said mounting bracket, and wherein one end of said mounting bracket is adapted to be fastened to said vehicle structure rearwardly of the exterior panel; said cylinder lock having a first end extending within an opening in the exterior panel and secured to the exterior panel, and said cylinder lock being supported by said mounting bracket at a second end of said cylinder lock rearwardly of the exterior panel, said first and second raised portions cooperating with a portion of the vehicle structure to substantially prevent rotation of the mounting bracket relative to the vehicle structure.

12. The combination according to claim 11, wherein said mounting bracket includes a base portion, said lock mounting portion including first and second arms extending from said base portion, said first and second arms including first and second inner surfaces which define said first and second mounting surfaces.

13. The combination according to claim 12, wherein said base portion includes first and second ends, said first and second arms extending from said base portion near said first end of said base portion, and said mounting lug projecting from said base portion near said second end of said base portion.

14. The combination according to claim 12, wherein said arms have end portions which have generally arcuate surfaces for receiving said lock housing of said cylinder lock.

15. The combination comprising:

a mounting bracket adapted to be fastened to a vehicle structure associated with an exterior panel of a motor vehicle, said mounting bracket including at least one mounting lug and a lock mounting portion; and a cylinder lock received on said mounting bracket, said cylinder lock including a lock housing having an outer surface with a plurality of index portions projecting outwardly from said outer surface;

said lock mounting portion of said mounting bracket defining at least first and second mounting surfaces which cooperate with said index portions of said lock housing to substantially prevent axial movement and rotation of said cylinder lock with respect to said mounting bracket, and wherein one end of said mounting bracket is adapted to be fastened to said vehicle structure rearwardly of the exterior panel; said cylinder lock having a first end extending within an opening in the exterior panel and secured to the exterior panel, and said cylinder lock being supported by said mounting bracket at a second end of said cylinder lock rearwardly of the exterior panel, wherein said mounting bracket includes a base portion, said lock mounting portion including first and second arms extending from said base portion, said first and second arms including first and second inner surfaces which define said first and second mounting surfaces, and wherein said first and second inner surfaces include first and second channels, respectively, a portion of each channel having a raised portion with inwardly tapering sides.

16. The combination according to claim 15, wherein at least said first and second indexing portions include first and second slots, respectively, said first and second slots having a profile that is complementary to the profiles of said first and second raised portions, respectively, of said first inner surface.

17. The combination according to claim 15, wherein one of said raised portions is larger than the other one of said raised portions.

18. The combination comprising:

a mounting bracket adapted to be fastened to a vehicle structure associated with an exterior panel of a motor vehicle, said mounting bracket including at least one mounting lug and a lock mounting portion; and a cylinder lock received on said mounting bracket, said cylinder lock including a lock housing having an outer surface with a plurality of index portions projecting outwardly from said outer surface;

said lock mounting portion of said mounting bracket defining at least first and second mounting surfaces which cooperate with said index portions of said lock housing to substantially prevent axial movement and rotation of said cylinder lock with respect to said mounting bracket, and wherein one end of said mounting bracket is adapted to be fastened to said vehicle structure rearwardly of the exterior panel; said cylinder lock having a first end extending within an opening in the exterior panel and secured to the exterior panel, and said cylinder lock being supported by said mounting bracket at a second end of said cylinder lock rearwardly of the exterior panel, wherein said mounting bracket includes a base portion, said lock mounting portion including first and second arms extending from said base portion, said first and second arms including first and second inner surfaces which define said first and second mounting surfaces, and wherein the base portion includes first and second shoulders for cooperating with a portion of the vehicle structure to substantially prevent rotation of the mounting bracket relative to the vehicle structure.

19. A mounting bracket for mounting a cylinder lock to an exterior panel of a motor vehicle, said cylinder lock having a lock housing, said mounting bracket comprising:

a base portion;

a mounting lug projecting from said base portion, said mounting lug being adapted to be fastened to a vehicle structure associated with the exterior panel; and a lock mounting portion extending from said base portion, said lock mounting portion defining at least first and second mounting surfaces for cooperating with said lock housing of said cylinder lock to prevent axial movement and rotation of said cylinder lock, wherein at least one of said first and second mounting surfaces defines one of a tenon and a mortise of a dovetail joint.

20. The mounting bracket according to claim 19, wherein said lock mounting portion includes first and second arms extending generally perpendicular to said base portion, said first and second arms having first and second inner surfaces which define said first and second mounting surfaces.

21. The mounting bracket according to claim 20, wherein said first and second arms extend generally perpendicular to said base portion near a first end of said base portion, and said mounting lug projects from said base portion near a second end of said base portion.

22. The mounting bracket according to claim 20, wherein said first and second inner surfaces include first and second channels, respectively, a portion of each of said channels having a raised portion with inwardly tapering sides defining a tenon of a dovetail joint.

23. The mounting bracket according to claim 20, wherein said first and second arms have end portions which are generally arcuate in shape and are dimensioned and arranged to receive said lock housing of said cylinder lock between said first and second arm end portions.

24. The mounting bracket according to claim 22, wherein one of said raised portions is larger than the other one of said raised portions.

25. The mounting bracket according to claim 19, and including first and second shoulders for cooperating with a portion of the vehicle structure to substantially prevent rotation of the mounting bracket relative to the vehicle structure.

26. A mounting bracket for mounting a cylinder lock to an exterior panel of a motor vehicle, said cylinder lock having a lock housing and a lock cylinder mounted within said lock housing for rotation between a locked position and an unlocked position to operate a latching mechanism to unlatch a deck lid, said mounting bracket comprising:

a base portion;

a mounting lug projecting from said base portion, said mounting lug being adapted to be secured to a vehicle structure associated with the exterior panel at a location adjacent the latching mechanism; and a lock mounting portion extending from said base portion, said lock mounting portion defining at least first and second mounting surfaces for cooperating with said lock housing of said cylinder lock to prevent rotation of said cylinder housing with respect to said mounting bracket, wherein said first and second mounting surfaces have a raised portion with sides that are tapered inwardly.

* * * * *